United States Patent [19]

Yoshida

[11] Patent Number: 4,754,692

[45] Date of Patent: Jul. 5, 1988

[54] FLUID CONTROL SYSTEM

[75] Inventor: Tokunao Yoshida, Hitachi, Japan

[73] Assignee: Hitachi Juki Sekkei Co., Ibaraki, Japan

[21] Appl. No.: 19,194

[22] Filed: Feb. 26, 1987

[30] Foreign Application Priority Data

Feb. 28, 1986 [JP] Japan ..... 61-44753

[51] Int. Cl.[4] ..... F15B 13/042

[52] U.S. Cl. ..... 91/390

[58] Field of Search ..... 91/376 R, 390, 398

[56] References Cited

U.S. PATENT DOCUMENTS 3,428,298 2/1969 Powell ..... 91/390 X
3,621,756 11/1971 Ulbing ..... 91/390 X
3,894,476 7/1975 Cobb ..... 91/390 X

FOREIGN PATENT DOCUMENTS 29470 3/1979 Japan .

*Primary Examiner*—Robert G. Nilson
*Attorney, Agent, or Firm*—Antonelli, Terry & Wands

[57] ABSTRACT

A fluid control system of this invention is constituted by a controller and a cylinder (21). The controller comprises: for example, a box (4) having a first chamber (18) having a fixed volume to which a fluid is supplied from a fluid pressure generating source and a second chamber (19) of a variable volume which is connected to a cylinder port (29), such chambers (18) and (19) communicating with each other by a fluid passage (2); a casing (8) engaged with the box (4) for relative movement in the direction of action of a load and having a fluid discharging passage (15) communicating with said second chamber (19) of said box (4); and a valve (5) arranged so that fluid passages (2, 3) respectively between the first chamber (18) and the second chamber (19) and between the second chamber (9) and the fluid discharging passage (15) are closed in the case of no application of a load or an external force while they get into different states in the case of application thereof. The control automatically detects the load, and the fluid modulated to a pressure matched with the detected load is supplied to the cylinder port (29), thereby maintaining the balance of forces with respect to the load. This invention enable the provision of load transfer apparatus or pressure applying apparatus in which the manufacturing cost is further low, the operation is safe and easy and the energy consumption is further low.

3 Claims, 3 Drawing Sheets

FLUID CONTROL SYSTEM

BACKGROUND OF THE INVENTION

1. Field of the Invention

The present invention relates generally to a fluid control system, and in particular to a fluid control system for use in transferring a load.

2. Description of the Prior Art

Conventional systems for causing a cylinder incorporated therein to automatically produce an output in response to fluctuations in a load acting on the cylinder are classified into two major categories; one type utilizing electrical processing and the other type utilizing an output provided by a fluid per se. Japanese Patent Laid-Open No. 29470/1979 discloses as the latter fluid control system an automatically sensitive control system for use with, for example, a cargo handling arrangement. This prior-art automatically sensitive control system is arranged in the following manner. The pressure fluid provided by a pressure supply source is introduced to the interior of a cylinder through a throttle valve for modulating an arm lifting speed by means of a manually-operated valve for applying a load. Simultaneously, the fluid pressure of the cylinder required to support the load is supplied to a pilot port of a pilot regulator through a pilot operated valve, thereby producing another fluid pressure at the same level of the fluid pressure supplied on a secondary side of this pilot regulator. In the meantime, still another fluid pressure is produced on the secondary side of the pilot regulator, such fluid pressure being at the same level as the fluid pressure held in the pilot port of the pilot regular by the cooperation of the pilot operated valve and the check valve. The thus-obtained pressure fluid is supplied to the cylinder through the pilot operated valve to keep the balanced state of a balancing device during load application. In addition, another manually-operated valve for non-load application is operated to supply the pressure fluid from the cylinder through the pilot operated valve to a throttle valve for regulating an arm lowering speed at which the arm is lowered, thereby performing the discharge of gases. By so doing, the internal pressure of the pilot port of the pilot regulator is blocked by the pilot operated valve, and this pressure is maintained by the non-load pilot regulator, thereby maintaining the balanced state of the balancing device during the non-load application.

However, the above-described automatically sensitive control system of the prior art requires relatively complicated circuit arrangement and operating procedures, so that the manufacture of the system requires relatively high costs and a considerable degree of concentration and skill are needed to operate the system. In addition, there is another problem in that its energy consumption is large.

SUMMARY OF THE INVENTION

The present invention has been devised in order to solve the aforesaid problems, and an object of the invention is to provide a fluid control system which can be manufactured at a low cost and safely operated with ease, and which enables the provision of machines used for transferring loads and applying pressure in which its energy consumption is further low.

To this end, the fluid control system of the present invention comprises: a cylinder having a piston connected to an output transmission element; a box subjected to a load or an external force and having a first chamber whose volume is fixed and a second chamber whose volume is variable, a first fluid passage placing such first and second chambers in communication with each other; a fluid supply passage disposed to supply a fluid from a fluid pressure generating source to the first chamber; a fluid duct disposed to connect the second chamber and a cylinder port of the cylinder; a load transmission element subjected to the load or the external force and engaged with the box for relative movement in the direction of action of the load, such load transmission element provided with a fluid discharging passage communicating with the second chamber of the box; a resilient member disposed to apply to the piston a fluid pressure matched with the total weight of the load transmission element, the output transmission element and the box; first and second fluid passages disposed respectively between the first chamber and the second chamber and between the second chamber and the fluid discharging passage; and a valve having opposite ends which close the first and second fluid passages in the case of no application of the load or the external force, but, in the case of application of the load or the external force, make the respective states of these passages differ from each other. The control comprised of the box and the load transmission element automatically detects the load, and the fluid modulated to a pressure matched with the detected load is supplied to the cylinder port, thereby maintaining the balance of forces with respect to the load. This invention enables the provision of load transfer apparatus or pressure applying apparatus in which the manufacturing cost is further low, the operation is safe and easy and the energy consumption is further low.

Specifically, the present fluid control system has a function of detecting an increase and a decrease in the weight of a load within the controller to increase and decrease the pressure of the fluid to be sent to the cylinder.

Referring to FIG. 1, when an external force, for example, a human hand's force is applied to the controller, for example, in the vertical direction, the pressure of the fluid supplied to the cylinder is necessarily increased or decreased. The thus changed fluid pressure is reversed to the controller by a pipe, and the controller increases or decreases the fluid pressure accordingly. The result is that the internal pressure of the cylinder is maintained at a constant level. This is because the controller controls the pressure irrespective of the level of the pressure produced by the fluid pressure generating source. Therefore, even if the controller is moved in the direction of action of the external force, for example, in the vertical direction to produce a differential pressure, this differential pressure is fed back so as to maintain the pressure in the internal chamber of the cylinder at a constant level.

The cylinder has heretofore been indirectly operated by a reducing valve and a change-over valve to forcibly move the load. According to the present invention, an external force is applied to the controller in the vertical direction, thereby moving the load with its balance being consistently maintained. Therefore, the external force may be a load sufficient to break the balance, and the magnitude of the load is hardly affected by the response speed of the controller.

Specifically, as long as no external force is applied to the controller, the load does not move from its initial position and remains stationary when the cylinder assumes its intermediate position. Therefore, the load is not vertically moved until an external force is applied so as to break the balance between the lad and an output from the internal chamber of the cylinder, for example, in the vertical direction. At this time, the unbalanced energy of the internal pressure of the cylinder is discharged or is supplied with energy to cancel the unbalanced state. Accordingly, since it is possible to reduce the amount of pressure fluid used to the minimum extent, the present system has meaning as an energy-saving measure, and the load is moved smoothly and lightly.

BRIEF DESCRIPTION OF THE DRAWINGS

The present invention will be understood by reference to the following detailed description and the accompanying drawings, wherein.

DESCRIPTION OF THE PREFERRED EMBODIMENTS

Figure 1:
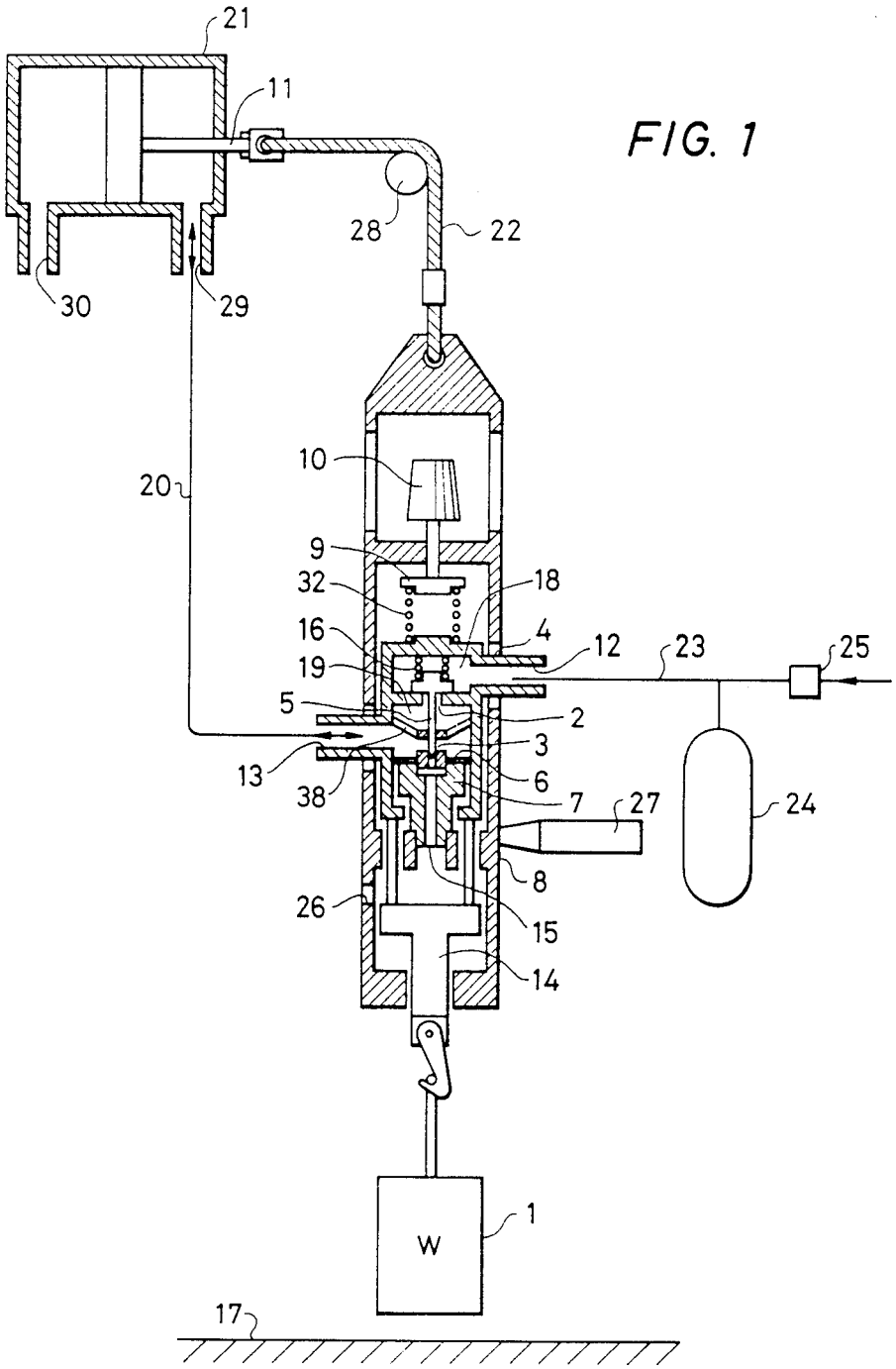
FIG. 1 schematically illustrates the essential portion of a load transshipping apparatus incorporating one preferred embodiment of a fluid control system of the present invention.

FIG. 1 illustrates one preferred embodiment of the present invention incorporated in a load transshipping apparatus, and depicts an example in which the present invention is connected to a piston 11 of a known cylinder device. One end of the piston 11 is connected to a casing 8 by an output transmission element 22 made of rigid or flexible material. A box 4 is mounted in the interior of the casing 8 for free movement in the direction of action of a load. The box 4 has a fluid inlet 12, a valve 5, a fluid passage 2, a fluid port 13, and a partition wall 6 made of a expansion member such as a rubber sheet for hermetically sealing purposes, the box 4 supporting a load 1 by means of a lifting member 14. The partition wall 6 is secured to the casing 8 by a support 7. If the positional relationship between the valve 5 and a fluid passage 3 makes the head of the valve 5 turn upwardly or horizontally as viewed in FIG. 1, it is still necessary to smoothly move the valve 5. To this end, a spring 16 is disposed as shown. A spring 32 is a spring for urging the box 4 at a constant pressure toward the load 1. The insertion of this spring 32 in the illustrated manner normally ensures the cylinder output transmitted to the load 1 through the casing 8, the output transmission element 22 and the receiver 7. A spring receiver 9 and a push screw 10 for adjusting a push load may be disposed to adjust the pressure of the spring 32 as the occasion demands. The receiver 7 has a fluid passage 15 and the casing 8 communicates with the atmosphere via a hole 26 opened in the wall thereof, such casing 8 being opened at the atmospheric pressure. And a guide partition wall 38 with a central guide hole and one or more fluid passage holes is provided to guide the valve 5.

Therefore, when the load 1 is in contact with a ground 17, that is, at the time of a zero load, the box 4 and the lifting member 14 solely apply a load to the box 4, and thus the box 4 is subjected to a force equivalent in magnitude to the load and acting in the direction of action of the load. However, the valve 5 is supported by the casing 8 by means of the receiver 7 in such a manner that the travel of the valve 5 in the direction of action of the load is limited. Thus, the fluid passage 2 is opened, so that the pressure fluid flowing through the fluid inlet 12 and waiting in a first chamber 18 is allowed to flow into a second chamber 19, passing a pipe 20, and flowing into a designated port on the piston or head side of a cylinder 21. Simultaneously, the same fluid acts on the casing 8 via the partition wall 6 and the receiver 7. This represents the fact that the thrust produced by the piston 11 is in proportion to the thrust produced by the box 4 and acting in the direction counter to the load. In this proportional state, the box 4 is allowed to float upwardly to close the fluid passage 2. A thrust proportional to the pressure produced at this time acts on the cylinder 21 in the direction counter to the load. It is assumed here that the piston 11 and the partition wall 6 have the same pressure receiving areas. In the case of a system arranged to transmit a force relation of 1:1 based on the principle of the lever or the pulley, the same level of force acts on the casing 8 and the box 4 counter to the load via the output transmission element 22. This is one relation of various proportional output relations, so that, if the aforesaid force relation needs to be altered, the pressure receiving areas have only to be changed on the basis of the principle of the lever or the pulley. This proportional force relation is likewise established in a case were 100% of the weight of the load 1 acts on the system, that is, the load 1 is separated from the ground 17. In cases where a slight level of external force is applied to the casing 8 in the direction counter to the load, the system operates in a below-described manner. The slight level of external force applied to the casing 8 causes the piston 11 to produce a thrust counter to the load, thereby providing a capability of increasing the volume of the cylinder 21 in response to the level of the thrust produced. Simultaneously, this capability is transmitted to the partition wall 6 as a capability of lowering the internal pressure of the cylinder 21. Therefore, the box 4 is provided with a capability of traveling in the direction of action of the load. However, since the total weight of the box 4, lifting member 14 and load 1 acts on the box 4, the box 4 will resume the proportional output relation established between the cylinder 21 and the box 4 in the aforesaid fixed load relationship. This slight level of force continues to be applied to the casing 8, the load 1 can be continuously moved upwardly. When it is necessary to continuously move the load 1 downwardly, the system performs proportional output operations following procedures given by operations reverse to the above description. Next, during the period in which the load 1 starts contact with the ground 17 and is completely brought into contact therewith, that is, while the weight of the load 1 is changing from 100% to 0%, or until the load 1 completely floats from the ground 17, that is, while the aforesaid weight is changing from 0% to 100%, the process performed is the differential operation of the aforesaid principles of upward and downward movement of the load 1. Therefore, this will be readily anticipated by those skilled in the art and has been proved by our experiments. According to the constructional features, when the load 1 is transferred from a high position to a low position, this controller increases its fluid energy by performing the cargo work; whereas in the case of cargo work between the places at the same height, the controller start its operation when the continuous required energy level is approximately 0. In this case, an accumulator 24 and a reducing valve 25 are provided at intermediate points of a pipe 23 connected to the fluid inlet 12, and the reducing valve 25 may be modulated to provide a pressure at which the output of the piston 11 is the same as the maximum load relative to the output transmission element 22. When a grip 27 disposed on the casing 8 is operated in the direction counter to the load, the load 1 is floated as described previously. When the grip 27 is operated in the direction of action of the load, the pressure in the second chamber 19 is more than the pressure in the first chamber 18, and this causes the valve 5 to move upwardly against the spring 16 producing a slight output, thereby opening the fluid passage 2. Meantime, the fluid passage 3 is kept closed by the differential pressure between the second chamber 19 and the fluid passage 15, the pressure fluid is returned to the accumulator 24 through the fluid passage 2. Therefore, the fluid energy becomes reusable.

Figure 2:
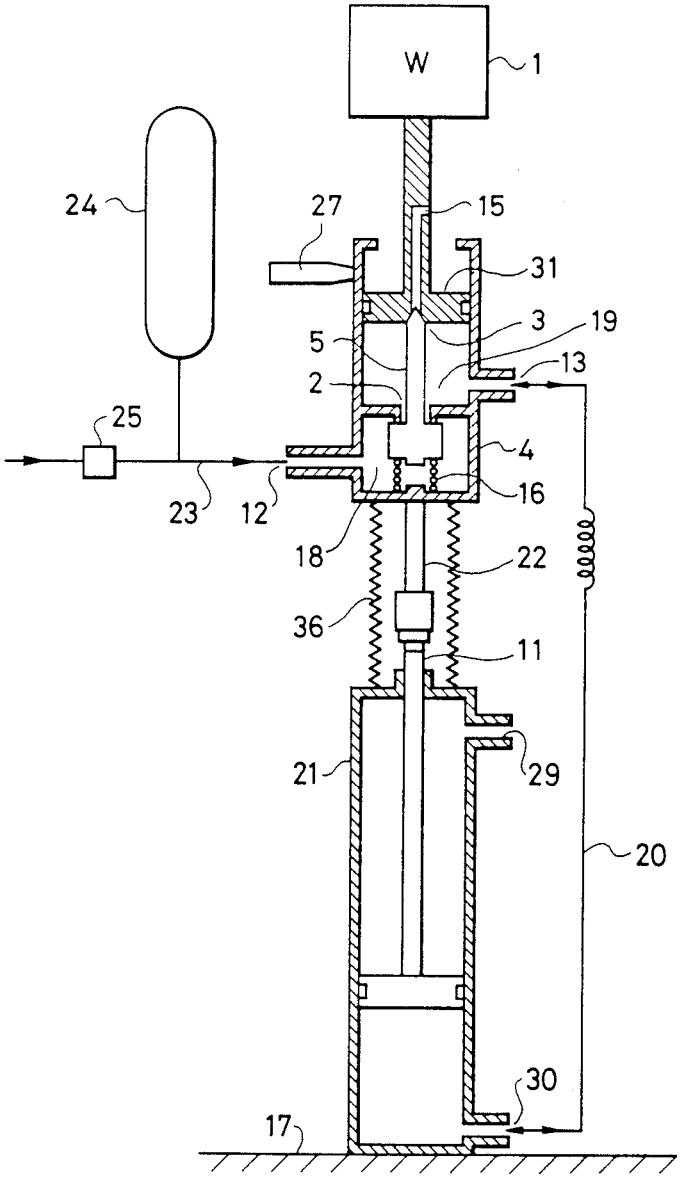
FIG. 2 schematically illustrates the essential portion of another load transshipping apparatus incorporating another preferred embodiment of the present invention.

FIG. 2 illustrates another embodiment of the present invention in which the cylinder 21 is disposed under the load 1 via the control system so as to control the weight acting on the cylinder 21. As shown in FIG. 2, like reference numerals are used to denote like or corresponding circuit elements which constitute each of the components shown in FIG. 1.

The load 1 is supported by the piston valve 31 incorporated in the box 4. The spring 16 has an enough resiliency to be capable of supporting only the weight of the valve 5. In this case, the load 1 urges the piston valve 31 and the valve 5 in the downward direction, and the bottom of the valve 5 is forced against the bottom of the box 4. The weight applied is the sum of the weights of the load 1 and the piston valve 31. The weights of the valve 5, the spring 16 and the grip 27 attached to the box 4 are made weightless by a spring 36.

In the meantime, an air source (not shown) supplies compressed air into the first chamber 18 through the reducing valve 25, the valve 23, and the fluid inlet 12. The compressed air is introduced into the second chamber 19 through the fluid passage 2 since the valve 5 is forced against the bottom of the box 4. The thus-introduced compressed air acts to float the piston valve 31 and at the same time is introduced into a designated cylinder 21 through a fluid port 30, thereby producing the thrust of the cylinder 21. While the fluid passage 2 is being opened, the compressed air continues flowing from the first chamber 18 to the second chamber 19. However, as the pressure in the second chamber 19 is increased to lift the piston valve 31 upwardly against the weight of the load 1, the valve 5 is moved up accordingly. This is because the valve 5 is made weightless by the differential pressure between the fluid passage 15 opened in the atmosphere and the second chamber 19, which communicate with each other via the fluid passage 3. Therefore, the fluid passage 2 is closed to stop the flow of the compressed air from the first chamber 18 into the second chamber 19. At this time, if the piston valve 31 and the piston 11 have the same pressure receiving areas, the sum of the weights of the load 1 and the piston valve 31 coincides with the thrust provided by the piston 11. Specifically, a balanced state is provided. If the weight of the load 1 is changed, this balanced state is lost. First, in cases where the weight of the load 1 is reduced, the current thrusts of the piston 11 and the piston valve 31 exceed the weight of the load 1. Therefore, the piston valve 31 and the piston 11 are moved upwardly. However, the upward movement of the piston valve 31 causes opening of the fluid passage 3 to continue discharging the pressure fluid into the atmosphere, and this causes reduction in the internal pressure of the second chamber 19 and the cylinder 21. The pressure fluid continues to be discharged until the piston valve 31 has moved to its lower position, that is, the thrust of the piston valve 31 has become unable to bear the load 1. When the thrust has become unable to bear the load 1, the piston valve 31 is moved downwardly to stop the discharge of the fluid from the the fluid passage 15. Specifically, a newly balanced state is reached. In cases where the weight of the load 1 is increased, the thrust of the piston valve 31 generated by the pressure in the second chamber 19 becomes unable to bear the increase in the weight and is moved downwardly. Thus, the fluid passage 2 is opened to supply the fluid from the first chamber 18 to the second chamber 19. This causes an increase in the pressure of the second chamber 2 and hence an increase in the thrust of the piston valve 31. When this thrust acts to push up the piston valve 31 against the increased weight of the load 1, the fluid passage 2 is closed, resulting in a newly balanced state. The continuation of the above-described operations means that, whenever the weight of the load 1 changes, the thrust of the piston 11 of the cylinder 21 is regulated to maintain a normally balanced state. When a slight level of external force is applied to the grip 27 in the upward direction, this external force is transmitted to the piston 11 through the box 4 and the output transmission element 22, thereby causing an increase in the volume of the cylinder 21 and hence a decrease in the internal pressure thereof. Simultaneously, this pressure decrease is transmitted to the second chamber 19 through the cylinder port 30, the pipe 20 and the fluid port 13, causing a decrease in the thrust of the piston valve 31. At this time, as described previously, the piston valve 31 becomes unable to bear the weight and is moved downwardly. Thus, the fluid passage 2 is opened and the pressure fluid is supplied until a balanced state is reached. The continuation of this operation means that he load 1 is moved upwardly by means of the box 4. In cases where a slight level of external force is applied to the grip 27 in the downward direction, a completely reverse operation is caused. Our experiments have demonstrated the fact that the height at which the load 1 is positioned can be changed by a slight level of operating force irrespective of the weight of the load 1 by a combination of the aforesaid continuous, combined load and the operating force.

Specifically, the pressure fluid supplied through the fluid port 12 simultaneously acts on the piston 11 and the piston valve 31. The total weight of the load 1 and the piston valve 31 directly acts on the valve 5, but the weight of the valve 5 is received by the spring 16. Although the valve 5 in FIG. 1 receives the partition wall 6, the same in this structure receives the box 4 so as to allow the free movement of the piston valve 31 in the direction of action of the load. The basic action of the fluid in this structure is the same as that shown in FIG. 1. While a suspending operation is simple in the previous embodiment shown in FIG. 1, a lifting operation is simplified in the embodiment of FIG. 2.

Figure 3:
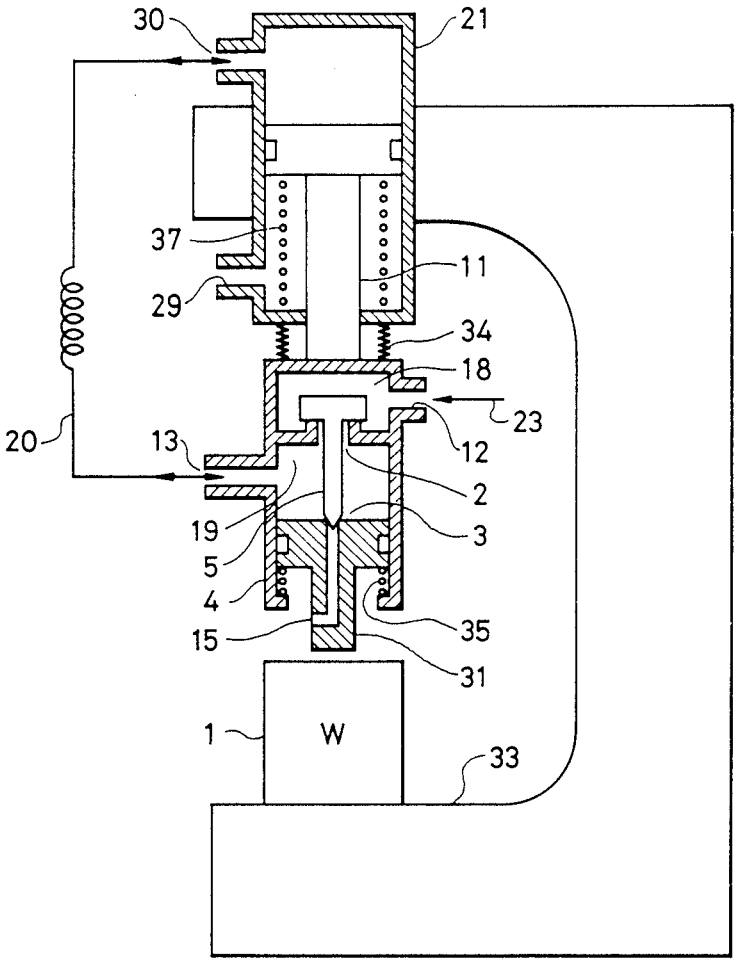
FIG. 3 schematically illustrates the essential portion of a hydraulic or pneumatic press incorporating yet another preferred embodiment of the present invention.

Yet another embodiment will be described below with reference to FIG. 3, and the following explanation refers to the fact that the present fluid control system functions as a control system for use with a fluid pressure producing apparatus. In FIG. 3, like reference numerals and names are used to denote like or corresponding elements which have the same functions as those in FIG. 2.

FIG. 3 illustrates yet another embodiment in which the present fluid control system is applied to a hydraulic or pneumatic press. The cylinder 21 is secured to a frame 33, and the load 1 is placed on the table of the frame 33. The box 4 is mounted on one end of the piston 11, and a spring 34 is inserted between the box 4 and the cylinder 21, thereby making the box 4 weightless. The piston valve 31 and the valve 5 are disposed in the box 4, such valves 31 and 5 being made weightless by a spring 35. In this embodiment as well, the box 4 is divided into the first and second chambers 18 and 19 in the same manner as the embodiments of FIGS. 1 and 2. The piston 11 is made weightless by a spring 37 disposed in the cylinder 21. A fluid flows through the fluid inlet 12 into the first chamber 18, and unless an external force is applied to the box 4, the valve 5 does not operated. When a downward load is applied to the box 4, the internal pressure of the second chamber 19 and the cylinder 21 are lowered, and the piston valve 31 is forced upwardly by the spring 35. Thus, the fluid passage 2 is opened to cause supply of the pressure fluid, and a newly balanced state is reached. If the small level of downward external force is kept to be applied to the box 4, that is, if an operation of breaking the balanced state is continued, the piston 11 continues to move downwardly until one end of the piston valve 31 comes into contact with the load 1. If this external force continues to be applied to the box 4 after commencement of the contact with the load 1, the pressure fluid continues flowing through the fluid passage 2 until a strong thrust force is accumulated in the piston 11. When one separates the box 4, that is, one stops applying the downward external force to the box 4, the balanced state is maintained and the load 1 is pressed with a strong force. In order to remove the pressure, an upward external force must be applied to the box 4 to again break the balance. This is the same as the principles depicted in FIGS. 2 and 3. In this embodiment, it is possible to perform a hydraulic or pneumatic press operation by a small external force.

Specifically, the box 4 is secured to the piston 11 and connected to the cylinder 21 by the spring 34. The piston valve 5 is received from below by the spring 35 having a load equivalent to the weight of the valve 5. When a pressure fluid flows into the second chamber 19 through the fluid passage 2, if a slight level of external force is applied to the box 4, the box 4 can be vertically moved owing to its weightless state in the same manner as that of the embodiment shown in FIG. 1. Next, when one end of the piston 31 comes into contact with the load 1 causing a pressure, the output of the piston 21 is balanced in response to the pressure load. This has also been described with reference to FIG. 1.

As described above, these preferred embodiments are mounted in association with a known fluid cylinder to normally control the output of the cylinder which receives a fluctuating load in response to the magnitude of the fluctuating load. In consequence, as the fluctuating load is automatically balanced, the transfer of the load and the generation of pressure can be performed with a small operating force and at a given speed. The manufacturing cost is low, no special switch is needed, and the safe and smooth operation is enabled. In addition, the present invention possesses the advantage of lowering the running cost.

What is claimed is:

1. A fluid-control system which instanteously detects the weight of a load, making said load weightless in real time, thereby allowing said load to be freely moved by a slight force of an operator, comprising:

a cylinder having a piston connected to an output transmission element;

a box receiving a load or an external force and having a first chamber whose volume is fixed and a second chamber whose volume is variable, a first fluid passage placing said first and second chambers in communication with each other;

a fluid supply passing disposed to supply a fluid from a fluid pressure generating source to said first chamber;

a fluid port disposed to connect said second chamber and a cylinder port of said cylinder;

a load transmission element subjected to said load or said external force and engaged with said box for relative movement in the direction of action of said load, said load transmission element being provided with a fluid discharging passage communicating with said second chamber of said box;

a resilient member disposed to transmit a force to said piston which is equal to the total weight of said load transmission element, said output transmission element and said box;

first and second fluid passages disposed respectively between said first chamber and said second chamber and between said second chamber and said fluid discharging passage; and a valve having opposite ends which are arranged to close said first and second fluid passages in the case of no application of said load or said external force while, in the case of application of said load or said external force, said valve is operated, depending on whether said load or said external force is applied.

2. A fluid control system according to claim 1, wherein said load transmission element includes a casing connected to said output transmission element, said box being disposed in said casing for movement in the direction of action of said load, and said second chamber being disposed in face-to-face relation to a receiver disposed on said casing, said fluid control system being characterized by having a partition wall made of a resilient member on which a valve seat of said valve is mounted.

3. A fluid control system according to claim 1, wherein said load transmission element further includes a piston valve slidablely disposed in said second chamber.

* * * * *